US008793903B2

(12) United States Patent
Xie

(10) Patent No.: US 8,793,903 B2
(45) Date of Patent: Aug. 5, 2014

(54) HALF-INSERT USED IN SETTING MIDDLE-SOLE OF SHOES

(75) Inventor: Haiyun Xie, Foshan (CN)

(73) Assignee: Lianhe Shoe Material Company, Foshan, Guangdong (CN)

( * ) Notice: Subject to any disclaimer, the term of this patent is extended or adjusted under 35 U.S.C. 154(b) by 481 days.

(21) Appl. No.: 13/131,647

(22) PCT Filed: Oct. 19, 2009

(86) PCT No.: PCT/CN2009/074507
§ 371 (c)(1),
(2), (4) Date: Aug. 14, 2011

(87) PCT Pub. No.: WO2010/139152
PCT Pub. Date: Dec. 9, 2010

(65) Prior Publication Data

US 2011/0283561 A1 Nov. 24, 2011

(30) Foreign Application Priority Data

Jun. 2, 2009 (CN) ..... 2009 2 0155645 U

(51) Int. Cl.
*A43B 7/14* (2006.01)
*A43B 13/41* (2006.01)
*A43B 23/22* (2006.01)

(52) U.S. Cl.
CPC ..... *A43B 23/22* (2013.01); *A43B 13/41* (2013.01); *A43B 7/144* (2013.01); *A43B 7/1445* (2013.01); *A43B 7/14* (2013.01)
USPC ..... 36/44; 36/76 R; 36/76 C

(58) Field of Classification Search
USPC ..... 36/43, 44, 72 A, 76 R, 76 C
See application file for complete search history.

(56) References Cited

U.S. PATENT DOCUMENTS

| | | | | | |
|---|---|---|---|---|---|
| 1,704,187 | A * | 3/1929 | Glidden et al. | ..... | 36/32 R |
| 1,985,919 | A * | 1/1935 | Delbon | ..... | 36/168 |
| 2,263,187 | A * | 11/1941 | Parkhurst | ..... | 36/24.5 |
| 3,333,353 | A * | 8/1967 | Garcia | ..... | 36/68 |
| 4,291,428 | A * | 9/1981 | Anzani | ..... | 12/146 B |
| 4,404,757 | A * | 9/1983 | Sweeny | ..... | 36/107 |
| 4,439,937 | A * | 4/1984 | Daswick | ..... | 36/107 |
| 5,638,613 | A * | 6/1997 | Williams | ..... | 36/43 |
| 6,895,695 | B1 * | 5/2005 | Chen | ..... | 36/24.5 |
| 7,421,808 | B2 * | 9/2008 | Baier et al. | ..... | 36/107 |
| 2008/0307672 | A1 * | 12/2008 | Ito | ..... | 36/28 |

* cited by examiner

*Primary Examiner* — Marie Bays
(74) *Attorney, Agent, or Firm* — MDIP LLC

(57) ABSTRACT

The present invention discloses a half fork for shoe molded insole, comprising a rigid plastic injection-molded main body, and a waist core integrated in the main body as a whole by plastic injection molding, wherein the main body has at least one locating hole on the upper and/or lower surfaces thereof in the waist core region, and bevels on the edges thereof. The half fork further comprises a surface material layer on upper and/or lower surfaces of the main body; the material of the surface material layer is fabric, paper or plastic. The half fork disclosed by the present invention will not deform easily under the pressure caused by the weight of the wearer, even in the humid environment or under the condition of being soaked, it is more comfortable, durable and artistic.

10 Claims, 3 Drawing Sheets

HALF-INSERT USED IN SETTING MIDDLE-SOLE OF SHOES

FIELD OF THE INVENTION

The present invention relates to a half fork for shoe molded insole.

BACKGROUND OF THE INVENTION

At present in the footwear manufacturing industry, it is generally known that a common half fork for shoe molded insole comprises a paper plate with an elongated rigid shank board made of iron therein. The insoles of this type (made of paper) will be easy to suffer from deformation under the pressure caused by the weight of the wearer during walking or standing. In addition, after used for a period in a humid environment or under the condition of being soaked, the paper insoles are easy to deform or damage as well, whereby wearing comfort is greatly affected and service life is significantly shortened. As a result from above discussions, there is a need to improve the present insole design.

SUMMARY OF THE INVENTION

To address abovementioned problems, the present invention provides a new type half fork for shoe molded insole with a longer lifespan and more comforts by a rational construction.

The technical solution provided by the present invention for solving the abovementioned problems is as follow: a half fork for shoe molded insole, comprising a rigid plastic main body formed by injection molding, and a waist core enveloped in the main body, wherein the main body and the waist core are integrated as a whole by plastic injection molding, and the main body has at least one locating hole on the upper and/or lower surfaces thereof in the waist core region.

As another aspect of the present invention, on the upper surface of the main body two locating holes are respectively arranged in the two ends of the waist core region, and on the lower surface of the main body a locating hole is arranged in the middle of the waist core region. The main body further has bevels on the edges thereof.

The half fork further comprises a surface material layer on the upper and/or lower surfaces of the main body; the material of the surface material layer is fabric, paper or plastic.

The advantages of the present invention are as follows.

The main body of the half fork disclosed by the present invention is made of rigid plastic, and the waist core is integrated with the main body as a whole through the process of plastic injection molding for forming the main body, the half fork is so characterized in a much solider structure. The locating holes arranged on the upper and/or lower surfaces of the main body in the waist core region, ensure that the waist core is exactly located in the center of the main body in the plastic injection molding process, the processing accuracy is so enhanced. As a result form above, the half fork provided by the present invention is more wearable and comfortable.

Furthermore, in the present invention the front edge of the half fork is designed to be a bevel, which provides larger contact area between the half fork and the insole for enhanced bonding strength, consequently to make the final products solider and more durable. In addition, the upward bevels on the edges of the half fork conforming to the shape of the heel make the final products more artistic. These upward bevels also increase the upper surface area, which is namely the contact area between the foot and the insole, to provide more comforts.

In brief, the half fork disclosed by the present invention will not deform easily under the pressure caused by the weight of the wearer, even in the humid environment or under the condition of being soaked, it is more comfortable, durable and artistic.

The subject matter will become more clearly understood in light of the ensuing description of embodiments herein, with reference to the accompanying drawings.

BRIEF DESCRIPTION OF THE FIGURES

The following description of the figures and the respective drawings are non-limiting examples that depict various embodiments that exemplify the present invention.

DETAILED DESCRIPTION OF THE INVENTION

Figure 1:
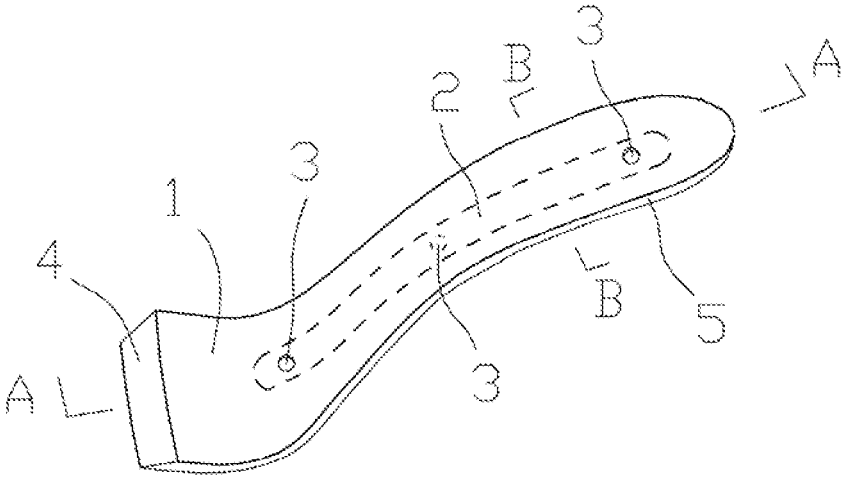
FIG. 1 is a schematic view of the half fork according to the present invention.
Figure 2:
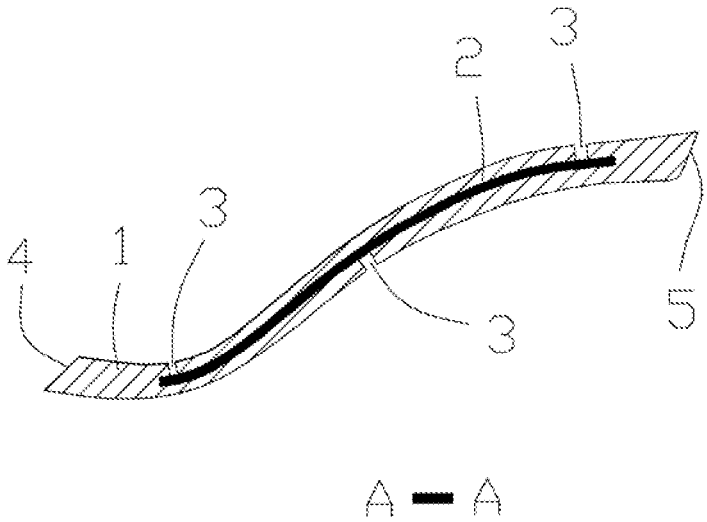
FIG. 2 is a sectional view of A-A in FIG. 1.
Figure 3:
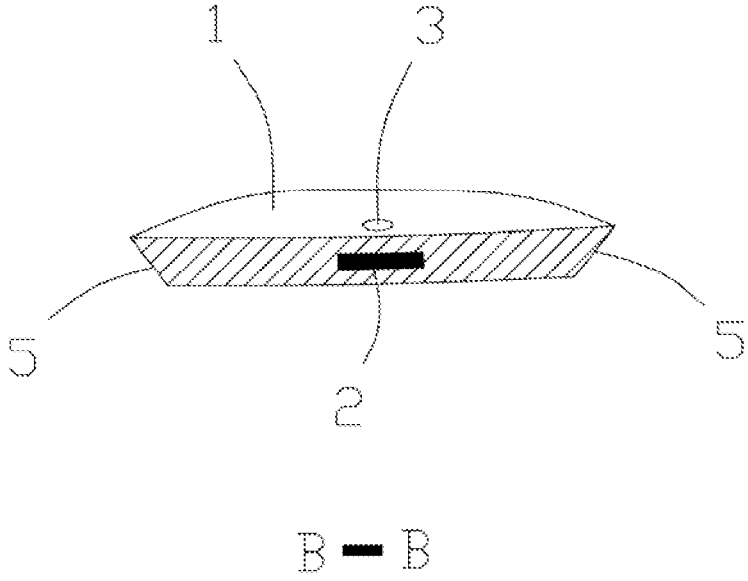
FIG. 3 is a sectional view of B-B in FIG. 1.

As shown by FIGS. 1, 2 and 3, the half fork provided by the present invention comprises a rigid main body 1 formed by plastic injection molding, and a waist core 2 enveloped in the main body 1, wherein, the waist core is integrated with the main body 1 as a whole through the plastic injection molding process for forming the main body 1, the main body 1 is provided with at least one locating hole 3 on the upper or/and lower surfaces thereof in the waist core region.

As a further improvement to the above technical solution relating, on the upper surface of the main body 1 one locating hole 3 is arranged in each of the two ends of the waist core region, while on the lower surface one locating hole 3 is arranged in the middle of the waist core region. This arrangement ensures that the waist core 2 is located between the upper and lower surfaces of the main body 1 in plastic injection molding. Preferably, the waist core 2 is placed in the center of the main body 1 to provide a solider structure.

The front edge 4 of the main body 1 is designed into a bevel, facing downwards or upwards according to needs, in this embodiment a downward arrangement is selected for more conveniences in the follow-up processes. The bevel could provide a larger contact area between the half fork and the forepart of the shoe molded insole for enhanced the adhesion strength, therefore to enhance the overall strength of the final product for loner service life. The other surrounding edges 5 (the edges of the main body 1 except the front edge 4 described above), are processed into upward bevels (that means that the half fork is wider at the top except the front end), which not only can enhance the appearance of the final product as the bevels conform to the shape of the heel but also can provide more comforts as they enlarge the contact area between the foot and the insole.

Figure 4:
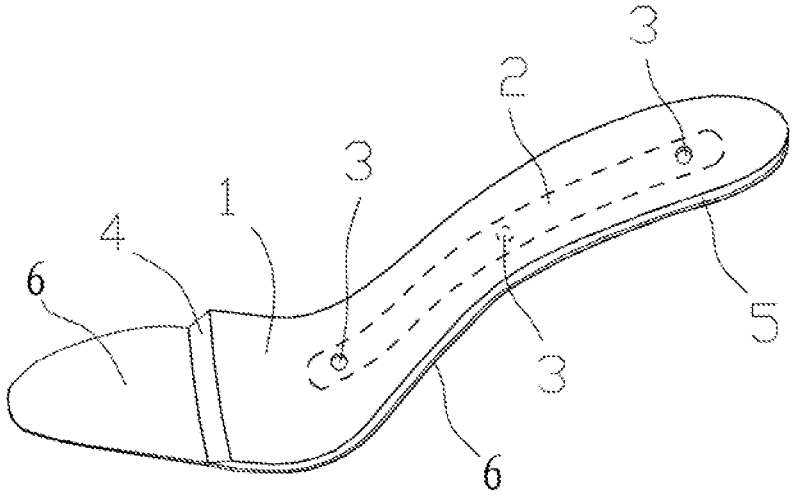
FIG. 4 is a schematic view of the half fork with surface materials according to the present invention.

As shown by FIG. 4, the half fork further comprises a surface material layer 6 on the upper and/or lower surfaces of the main body 1; the material of the surface material layer 6 may be fabric, paper or plastic.

The half fork disclosed by the present invention will not deform easily under the pressure caused by the weight of the wearer, even in the humid environment or under the condition of being soaked, it is more comfortable, durable and artistic.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

I claim:

1. A shoe molded insole, comprising rigid plastic injection-molded main body comprising an upper surface and as lower surface, and a waist core enveloped in the main body, wherein the waist core and the main body are integrated as a whole through plastic injection molding, wherein the upper surface of said main body comprises two locating holes at the ends of the waist core region.

2. The insole according to claim 1, further comprising a locating said lower surface of said main body.

3. The insole according to claim 1, wherein said main body has a bevel on a front edge thereof.

4. The insole according to claim 2, wherein main body has a bevel on a front edge thereof.

5. The insole according to claim 3, wherein said main body has an upward bevel on another edge thereof.

6. The insole according to claim 4, wherein said main body has an upward bevel on another edge thereof.

7. The insole according to claim 1, wherein said main as an upward bevel on an edge thereof.

8. The insole according to claim 2, wherein said main body has an upward bevel on an edge thereof.

9. The insole according to claim 1, further comprising a surface material layer on said upper surface and/or said lower surface of said main body.

10. The insole according to claim 9, wherein said surface material comprises fabric, paper or plastic.

* * * * *